United States Patent [19]

Suzuki et al.

[11] Patent Number: 4,623,292

[45] Date of Patent: Nov. 18, 1986

[54] SHEET STACK DELIVERY METHOD AND APPARATUS

[75] Inventors: Kozo Suzuki; Takateru Sakaguchi, both of Hyogo; Osamu Tomita, Osaka; Yoshiaki Tanaka, Hyogo, all of Japan

[73] Assignee: Kanzaki Paper Manufacturing Co., Ltd., Tokyo, Japan

[21] Appl. No.: 683,688

[22] Filed: Dec. 19, 1984

[30] Foreign Application Priority Data

Dec. 21, 1983 [JP] Japan ..... 58-243154

[51] Int. Cl.[4] ..... B65H 3/50

[52] U.S. Cl. ..... 414/114; 414/119; 414/786

[58] Field of Search ..... 414/112, 114, 115, 119, 414/121, 786

[56] References Cited

U.S. PATENT DOCUMENTS

| | | | |
|---|---|---|---|
| 3,155,244 | 11/1964 | Rogers et al. | 414/115 |
| 3,176,859 | 4/1965 | Prager | 414/114 |
| 3,206,042 | 9/1965 | Peterson | 414/114 |
| 3,211,301 | 10/1965 | Welhouse | 414/114 |
| 3,701,441 | 10/1972 | Gadler | 414/114 |
| 3,966,059 | 6/1976 | Sase | 414/114 |
| 4,247,093 | 1/1981 | Kistner et al. | 414/114 X |

FOREIGN PATENT DOCUMENTS

| | | | |
|---|---|---|---|
| 2649959 | 5/1978 | Fed. Rep. of Germany | 414/114 |
| 2735721 | 2/1979 | Fed. Rep. of Germany | 414/114 |
| 52-13738 | 3/1977 | Japan . | |
| 55-36421 | 8/1980 | Japan . | |
| 56-21704 | 5/1981 | Japan . | |
| 58-162447 | 9/1983 | Japan . | |
| 58-183560 | 10/1983 | Japan . | |
| 949751 | 2/1964 | United Kingdom | 414/114 |
| 2090815 | 7/1982 | United Kingdom | 414/114 |

*Primary Examiner*—Leslie J. Paperner

*Attorney, Agent, or Firm*—Morgan & Finnegan

[57] ABSTRACT

Sheet stacks bordered by sheet markers are sequentially fed from a pile of aligned and stacked sheets containing sheet markers inserted into these sheets through end wall at specific intervals with bare portion left outside, using a sheet stack delivery apparatus including at least lifter means that mounts sheet stacks to allow the uppermost sheet stack to be sequentially transferred to a predetermined level; a wedge-type head for separating sheet stacks comprising its tip part facing the end wall of the sheet pile at a position close to the sheet marker bordering the uppermost and the second sheet stacks and also the upper tilt surface and the bottom surface ending at the tip part; and means for transferring the uppermost sheet stack by holding and pushing forward an end wall of the uppermost sheet stack split by the wedge head.

4 Claims, 24 Drawing Figures

Fig. 10.
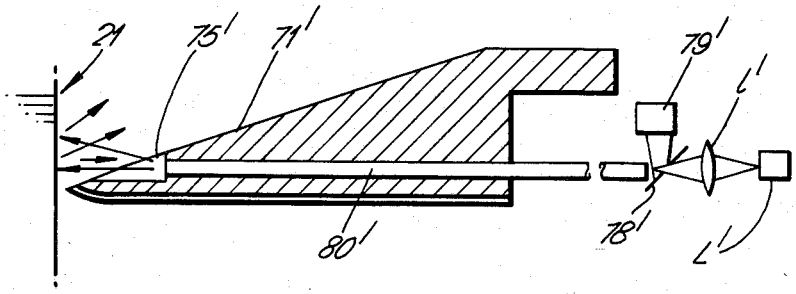
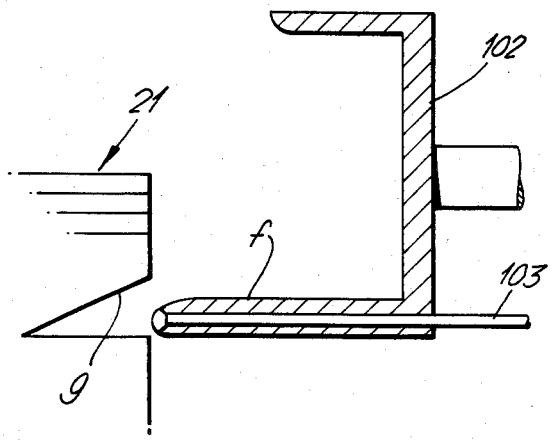
Fig. 11.
Fig. 13.
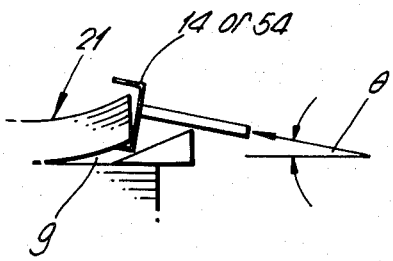

SHEET STACK DELIVERY METHOD AND APPARATUS

FIELD OF THE INVENTION

The present invention relates to a method of delivering sheet stacks, more particularly, to a method an apparatus for drawing out a specific number of sheets from sheet stacks in pile for delivery to ensuing processes.

BACKGROUND OF THE INVENTION

Conventionally, any sheet products made of paper, plastics, cloth, metal foil, etc. are first cut into a specific size by cutters, for example, by a sheet cutter or a guillotine cutter, and then defective sheets are eliminated by using a fault detector or by visual inspection of inspectors as required, and then a specific number of sheets are split into a single unit (hereinafter called "sheet stack"), which are finally packed and delivered.

When performing these operations, it is necessary to relocate sheet stacks in pile. It has long been practiced during the sheet cutting process to insert sheet marker papers into the cut sheets at specific intervals before operators manually grasp each sheet stack between the marker papers for delivery to ensuring processes. However, since each sheet stack contains a considerably heavy weight, operators have been not only obliged to sustain hard labor, but such a conventional practice also requires a considerably long time to carry out such serial operations. As a result, a variety of apparatuses capable of continuously delivering sheet stacks have gradually been developed in these years.

For example, an automatic paper feeder disclosed by the Japanese Utility Model Publication No. 21,704 of 1981 is designed to transfer a specific number of sheets in stack to the ensuing process after counting each piece of sheets from the sheet pile. Such an apparatus however contains a complex counting mechanism and costs a fairly long time for counting the actual number of sheets. On the other hand, an apparatus disclosed by the Japanese Patent Laid-Open No. 183,560 of 1983 uses a computer for converting the number of the required sheets into the layer thickness value before transferring the sheet layer thus defined. Such a device still needs to define the actual standard and grade of papers being dealt and the calculation needed for said conversion against each specific number of sheets, and in addition, it has an extremely complex mechanism for measuring the sheet layer thickness.

Another apparatus disclosed by the Japanese Patent Laid-Open No. 162,447 of 1983 provides such a mechanism designed for pushing forward an appropriate number of sheets from the sheet pile to ensuing processes by using a pusher unit. This device however cannot optionally provide a specific number of sheets for delivery because the number of sheets in stack is unavoidably constrained by the thickness of the sheet layer provided in conjunction with the pusher's capacity (normally, said thickness ranges from several centimeters to a maximum of 10 centimeters), i.e., it is unavoidably subject to the height for performing one-round lifting operation with a lift mounted with a sheet stack. The same also applies to such an apparatus which is provided with means for sandwiching sheet layers for transferring sheet stacks according to the disclosed Japanese Utility Model Publications of 1980, Nos. 36,421 and 47,779.

Likewise, there is a still further apparatus disclosed by the Japanese Utility Model Publication No. 13,738 of 1977, which is composed of such a mechanism designed for lifting the previously counted sheet stack from the level of a spacer inserted between sheet stacks. In this case, the spacer is designed to project itself from the edge line of the designated sheet stack along full width of the sheets, thus it unavoidably involves a complex handling operation, and yet, it may malfunction any time unexpectedly.

As a result, such conventional sheet stack delivery apparatuses not only contain such inherent disadvantages mentioned above, but also contain such additional disadvantages typically found in terms of slow operating speeds, and absence of such means for securely protecting full surface of the lifted sheets when being separated from the sheet pile, and thus, such conventional devices cannot effectively be applied to the delivery of delicate sheets such as art paper, coated paper and highglazed finish paper, etc.

SUMMARY OF THE INVENTION

In the light of such circumstances thus described, it is an object of the invention to provide an extremely useful apparatus for automatically receiving a specific number of sheets divided from the sheet stack pile and safely delivering these to ensuing processes without causing any damage to occur.

To securely achieve the object described above, the present invention provides the method for sequentially feeding sheet stacks bordered by sheet markers from a pile of aligned and stacked sheets containing sheet markers inserted into these sheets through edge line at specific intervals with bare portion left outside, using a sheet stack delivering apparatus including at least lifter means that mounts sheet stacks to allow the uppermost sheet stack to be sequentially transferred to a predetermined level; a wedge-type head for separating sheet stacks comprising its tip part facing the edge line of the sheet pile at a position close to the sheet marker bordering the uppermost and the second sheet stacks and also the upper tilt surfaces and the bottom surface ending at the tip part; and means for transferring the uppermost sheet stack by holding and pushing forward an edge line of the uppermost sheet stack split by the wedge head; said method comprising the steps of:

(a) lifting a pile of sheets by driving the lifter in order that the uppermost sheet stack can be lifted to such a level allowing its transfer;

(b) sucking and holding the bare portion of the sheet markers between the uppermost sheet stack set at the transferrable level and the second sheet stack for causing gap to be generated between the sheet marker and the second sheet stack by raising the height position of suction means;

(c) inserting guide means composed of relatively rigid and smooth sheet into said gap generated by step (b);

(d) inserting the wedge head into gap above guide means inserted into said gap in such a manner where the bottom surface of the wedge head comes into contact with the upper surface of guide means so that said gap can be expanded to allow lifting of the uppermost sheet stack at its end wall; and (e) receiving and holding the end wall of the lifted sheet stack at the receiver part of the tip of feeding means and transferring the lifted sheet stack by forwarding said feeding means.

Basically, the sheet stack delivery apparatus embodied by the present invention comprises;

(a) lifter means for mounting and lifting sheet stacks to sequentially place the uppermost sheet stack onto the transferrable level;

(b) a wedge type head incorporating marker sensing means and sucking means for separating sheet stacks having the tip portion facing an end wall of the sheet stacks at a position close to the sheet marker bordering the transferrable sheet stack and the second sheet stack, the tilted upper surface and the flat bottom surface;

(c) a robot for functioning to hold and control the position and posture of the wedge head together with and in conjunction with said suction means, thereby causing the wedge head to rise for sensing the position of the sheet markers with sensing means and then slightly lift the bare portion of the sheet markers to suck and hold the bare portion at the lifted position to allow at least a portion of the wedge head to also rise for generating gap between the bottom surface of the sheet markers and the second sheet stack to be followed by releasing the sucking operation of the sheet markers before allowing entry of the wedge head into said gap;

(d) a rigid and smooth guide bar means being held in conjunction with the wedge head and slidably along the bottom surface of the wedge head for acting as the guide rail of the wedge head into said gap upon it having been inserted thereto;

(e) forwarding for holding and pushing forward an edge line of the uppermost sheet stack in order to transfer said sheet stack to ensuing processes.

According to the constitution of the present invention, by correctly identifying the needed number of sheets defined by sheet markers inserted into these sheets at specific intervals and also by generating a gap by slightly lifting the sheet markers, it has become possible to securely separate the transferrable uppermost sheet stack from the second layer of the sheet stacks without incurring even the slightest damage onto the sheet surface bordering them, and yet, without incorrectly dividing them, thus allowing the tip part of forwarding means to easily and securely receive the end wall of the separated sheet stack before delivery to the ensuing process.

Such advantages described above and other advantages obtainable by the present invention will be better understood by the following detailed description of the preferred embodiments in reference to the drawings attached hereto.

BRIEF DESCRIPTION OF THE DRAWINGS

FIG. 10 is a sectional view of the wedge-type head provided with a still further mechanism of sensing sheet markers available for the apparatus mebodied by the present invention;

FIG. 11 is a vertical sectional view showing the main part of the pusher unit operation in conjunction with the wedge-type head shown in FIG. 10;

FIG. 13 is a schematic diagram showing the drive pattern of another pusher unit used for the apparatus embodied by the present invention.

DETAILED DESCRIPTION OF THE PREFERRED EMBODIMENTS

Figure 1:
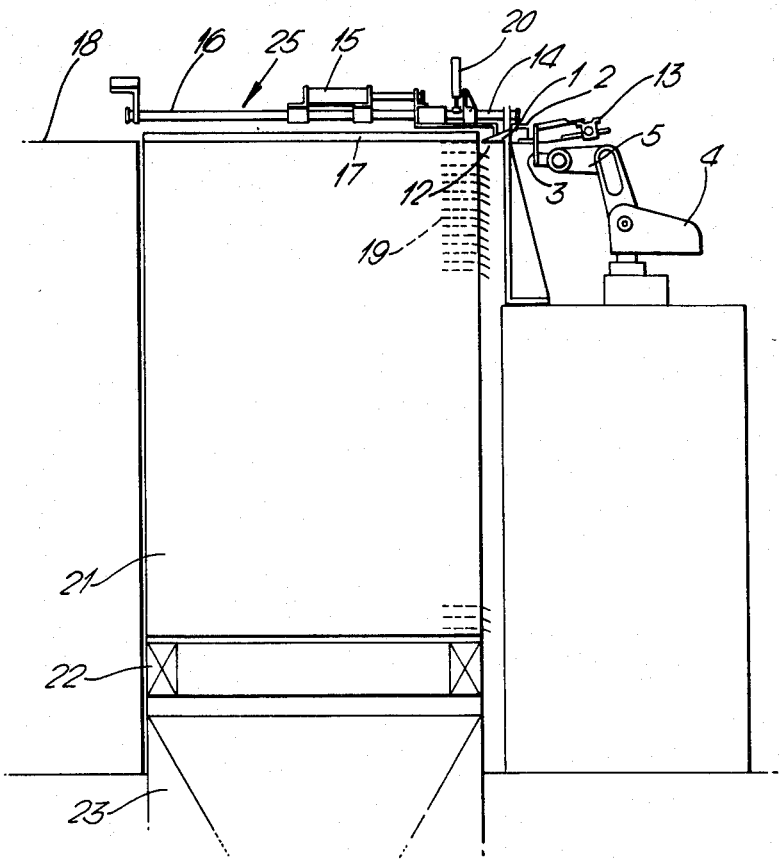
FIG. 1 is a lateral view showing the basic embodiment of such an apparatus used in conjunction with the method of delivering sheet stacks reflecting the present invention.

FIG. 1 shows one of the preferred embodiments of the present invention related to the sheet stack delivery method, which sequentially delivers sheet stacks split from sheet pile by sheet markers to an automatic packing machine. The sheet-stack delivery apparatus shown in FIG. 1 comprises a lifter 23 for loading thereon and lifting a sheet stack stepwise, a pneumatic cylinder 20 for pressing a portion close to the right end in this FIG. 1 of the upper surface of sheet pile 21 at a pre-determined level, a robot 4 supporting the wedge head 1 for splitting sheet stacks located in the upper right end in this FIG. 1 of the sheet pile 21, and the sheet stack feeder 25 that extends itself along the upper surface of sheet pile 21. An automatic packing machine 18 is installed at a position close to the other end of sheet pile 21 and opposite from the wedge head 1.

Figure 2:
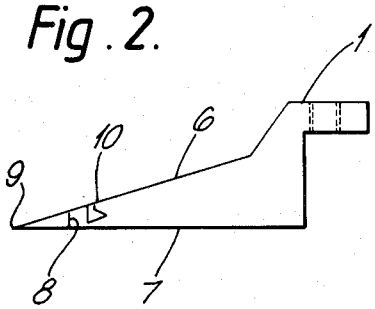
FIG. 2 is a lateral view of the wedge-type head used for the preferred embodiment shown in FIG. 1.
Figure 3:
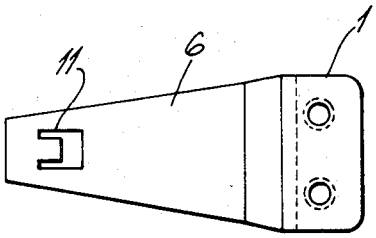
FIG. 3 is a plain view of the wedge-type head.

The wedge head 1 which is the main unit of the apparatus is secured, for example, to the arm member 5 of the robot 4 or the like by the head connector 2 and the support plate 3, while performing such operations including feeding of sheets, retreat itself, and up-and-down movements of its front and rear ends. Referring now to FIGS. 2 and 3, further details of the configuration of the wedge head 1 are described below. In FIG. 2, the front edge angle $\theta$ formed by the tilt surface 6 of the wedge head 1 projecting in the direction of sheet pile 21 and the flat and level bottom surface 7 should desirably be adjusted within a range from about 13° to a maximum of 30° so that no damage can be incurred to the sheet surface when inserting the tip end 9 of the wedge head 1 into the sheet pile. If the tip angle (8) exceeds 30°, the tip end of the wedge head 1 can hardly be inserted into the sheet pile 21. Conversely, if the tip angle 8 is norrower than 13°, even though the tip end of the wedge head 1 can be easily inserted, sheets will be easily damaged, and in addition, it will become difficult to precisely install sensors 10 in position, which will be described later on.

When the wedge head 1 ascends along the wall surface of the sheet pile 21, since it keeps ascending towards the wall surfaces of the sheet markers 19 and sheets, it is advantageous for the wedge head 1 to install sensors 10, for example, photoelectric sensor means onto the wedge head 1. In particular, as shown in the preferred embodiment, it is more desirable to install sensor means 10 either in the front edge of the lateral part or in the bottom edge portion of the tilt surface of the head 1.

As shown in FIG. 3, the bottom edge portion of the tilt surface 6 of the wedge head 1 is provided, for example, with such fixing means 11 comprising a suction hole, thus allowing the sheet marker 19 in contact with the tilt surface 6 can be securely sucked by a vacuum pump for fixing.

In consideration of the mechanical characteristics, processing characteristic, wear resistance, and low-abrasion characteristics, material for composing the wedge head 1 may be optionally selected, for example, from steel, non-ferrous metal, sintered material, or plastics. When handling such sheets that can easily incur any damage on the surface, for example, art paper, coated paper, and high-glazed finish paper, etc., such materials as phenol resin, polyamid resin, polyacetal resin, polytetrafluorethylene resin, POLYFLON YF, POLYFLON PF, and nylon containing molybdenum di-sulfide, etc. are particularly suited for composing the wedge head 1. Depending on the needs, the head surface can also be finished either by the hard chrome plating, surface quenching, or by the melted metal plating.

The bottom surface 7 of the wedge head 1 is provided with a guide blade 12 made of relatively rigid and thin material for guiding the wedge head 1 as shown in FIG. 1, for example, the guide blade 12 can be extended to any desired length from the tip end of the wedge head 1 along the bottom surface of the wedge head 1 by being driven by a lineared motor 13 so that the guide blade 12 can freely project or retreat itself. Conventionally, such a head guide is made of plastic materials for ensuring the surface smoothness. In particular, it is more desirable to use phenol resin, polyamid ressin, polyacetal resin, polytetrafluorethylene resin, POLYFLON YF, POLYFLON PF, or nylon containing molybdenum di-sulfide, etc.

The forwarding unit 25 comprises the forwarding arm 14 which, while remaining in the standby mode, is placed in such a position close to the end wall of sheet pile 21 on the part of the wedge head 1, the forwarding cylinder 14 for driving the forwarding arm 14, and the guide rod 16, where the forwarding arm 14 slides over the guide rod 16 to send out the split sheet stack 17 onto the automatic packing machine 18.

The pneumatic cylinder 20 available for pressing the sheet stacks is selectively provided when dealing with extremely slippy sheets to prevent either the collapse of sheet stack 17 or the disengagement of sheet markers from the sheet stacks 17.

When executing the method of delivering sheet stacks according to the invention by the preferred embodiment as shown in FIG. 1, first, the pallet 22 mounting sheet pile 21 is carried, for example, by either a folklift truck or by an automatic conveyer, and then the pallet 22 is transferred onto the table lifter 23, while the height position of the sheet stack 17 is adjusted to a desired level by the up-and-down movement of the table lifter 23. As described earlier, sheet markers 19 are inserted into sheet pile 21 so that the substantial bare portion of the sheet markers 19 can remain exposed at an edge line of the sheet pile, thus allowing to define each sheet stack 17.

Figure 4A:
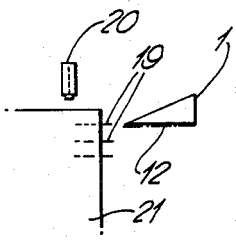
FIGS. 4A through 4H respectively show sequential processes performed for the delivery of sheet stacks using the apparatus shown in FIG. 1.
Figure 4B:
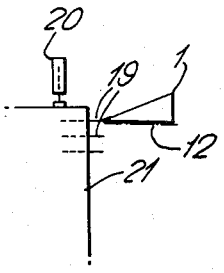

Next, in reference to FIG. 4, the procedure needed for forwarding sheet stacks is described below. FIG. 4A shows that every part of the delivery device remains in the initial status, where the press cylinder 20 withdraws its arm, while the tip end of the wedge head 1 is set in such a position slightly apart from the bare portion of the first sheet marker 19 and remains in a low position. As soon as the operation has been activated, as shown in FIG. 4B, the press cylinder 20 first extends its arm to press the upper edge portion of the sheet pile 21, and then the robot 4 drives the wedge head 1. First, the wedge head horizontally moves to the end wall of the sheet pile 21 and stops its movement at a position immediately before it comes into contact with the end wall of the sheet pile 21. The wedge head 1 then ascends in the direction of the uppermost sheet marker 19 while confirming the position of the sheet markers 19 and the end wall of the sheet pile using the photoelectric sensor incorporated, and then mounts the bare portion of the sheet marker 19 on its tilted surface, and finally stops at a slightly higher position.

Figure 4C:
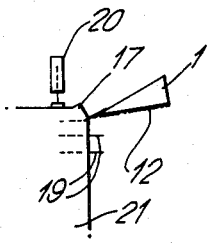
Figure 4D:
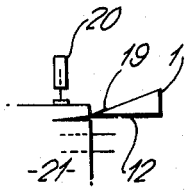
Figure 4E:
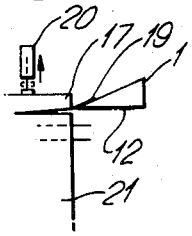
Figure 4F:
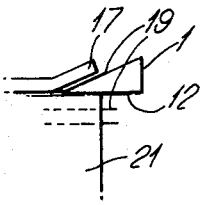

When the wedge head 1 stops, the suction hole provided on the tilt surface of the head 1 starts to operate so that the sheet marker 19 can be securely held on the tilt surface. Next, as shown in FIG. 4C, the rear end of the wedge head 1 is slightly brought upward by pivoting on the tip end of the head itself or thereabout so that gap enough to permit entry of the head guide 12 can be generated beneath the sheet marker 19 of the first sheet stack 17. After the head guide 12 has been inserted into gap thus generated, the wedge head 1 is then brought downward to a specific position suited for the guide to operate itself, and then the wedge head 1 returns to the horizontal position as shown in FIG. 4D. Then, as shown in FIG. 4E, the head guide 12 is inserted into sheet pile up to a depth enough to permit the wedge head 1 to enter inside, and then stops the sucking operation of the suction hole to release the sucked sheet marker 19. Likewise, the upper end of the sheet pile 21 is also set free by causing the arm of the press cylinder 20 to ascend. Then, the wedge head 1 moves over the head guide 12 and causes its front half portion to enter between the sheet marker 19 and the head guide 12. As a result, the end wall of the sheet stack 17 is lifted to a certain height needed for operating the forwarding arm 14 so that the condition shown in FIG. 4F can be entered into effect.

Figure 4G:
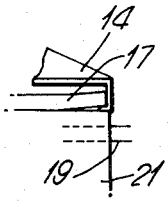
Figure 4H:
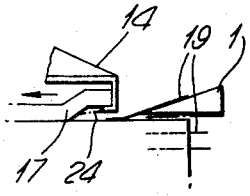

Next, the suction hole is reactivated to secure the sheet marker 19 onto the tilt surface of the wedge head 1, and then as shown in FIG. 4G, the hooked tip end of the forwarding arm 14 is set to the end wall of the lifted stack 17, and finally, the lifted sheet stack 17 is pushed outside in the direction of the automatic packing machine 18. As shown in FIG. 4H, when pushing forward the sheet stack 17, an air nozzle 24 is set to the forwarding arm 14, which then blows air into a certain portion beneath the lifted sheet stack 17 so that the sheet stack 17 can be easily sent out. This is particularly effective when drawing out such as sheet stack containing sheets that cannot easily slip. Besides, it is preferable, in considerably cold season, to blow ionized air into said certain portion beneath the lifted sheet stack 17 to prevent from clinging of the undermost sheet of the lifted stack to the upper surface of the wedge head 1.

As shown in FIG. 4H, when the first sheet stack 17 has been sent out, the sheet marker 19 still remains sucked upon the tilt surface of the wedge head 1, and thus, in order to prepare for the forwarding operation for the second sheet stack, when the wedge head 1 has returned to the initial state shown in FIG. 4A, the sucking operation against the sheet marker 19 is discontinued to release the sheet marker 19. In connection with the discontinuation of the sucking operation, to avoide the clinging of the sheet marker to the upper surface of the wedge head 1 by an electrostatic phenomenon, it is desirable to blow back ionized or moistened air through the suction hole 11 of the head 1 to the sheet marker 19. Further, the manner of producing a sufficient gap beneath the sheet marker 19 is not limited to such a manner as shown in FIG. 4C in which the rear end of the wedge head 1 is pivotally raised about the tip end thereof, but can be constituted from various manners, for example, the tip end may be rather raised about the rear end substantially reported, or the whole body of the wedge head 1 may be lifted maintaining the horizontal posture, and other possible manners can be employed in accordance with the implementation of the inventon.

The apparatus then repeats the same operation as was done by the procedures described above, thus sequentially sending out the piled sheet stacks. Needless to say, these operations can also be automatically and sequentially executed by the program control.

Figure 5:
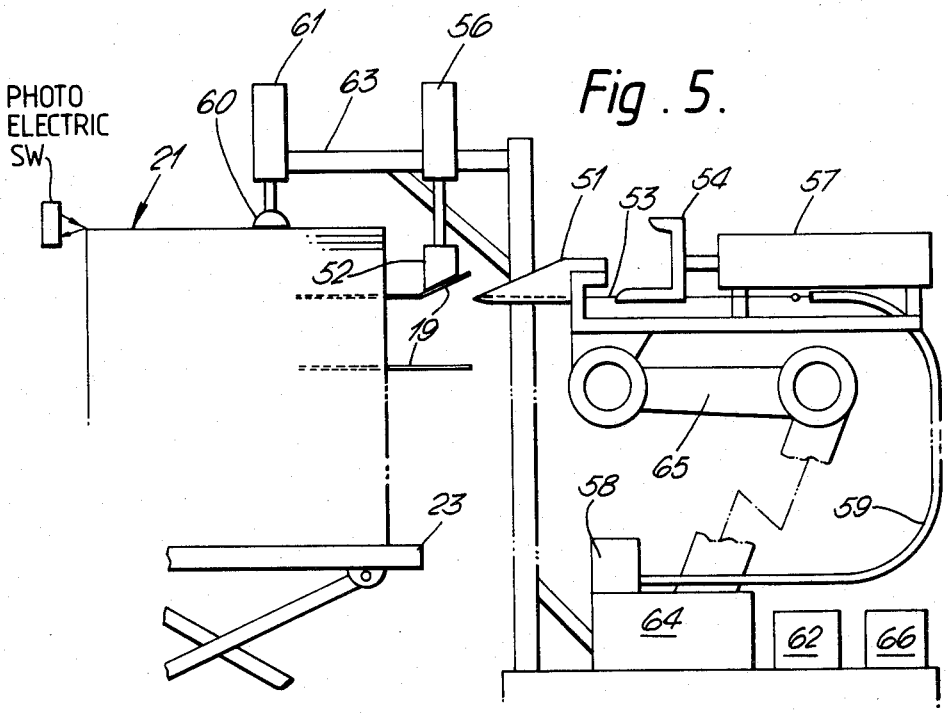
FIG. 5 is a lateral view of a configuration of an apparatus incorporating another preferred embodiment of the present invention.
Figure 6A:
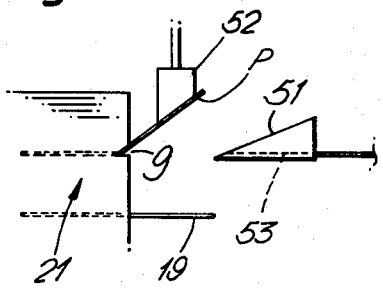
FIGS. 6A through 6D respectively show the principles of the sheet stack delivery operations sequentially performed by the apparatus shown in FIG. 5.
Figure 6B:
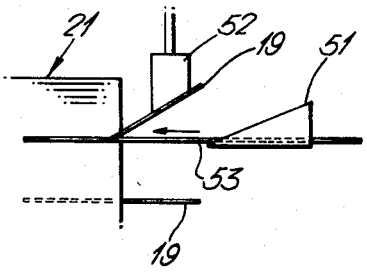
Figure 6C:
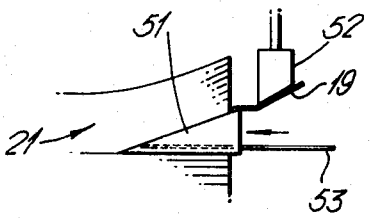
Figure 6D:
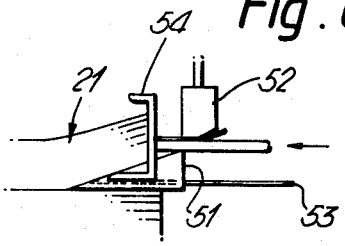

FIG. 5 shows a lateral view of a configuration of the apparatus incorporating another preferred embodiment of the present invention. The wedge head 51, guide bar 53, and the pusher unit 54 being quite similar to those used for the preferred embodiment described earlier, are respectively secured to the arm 65 of the robot 64 freely movable in the three dimensional directions X, Y, and Z. Sheet pile 21 mounted on the table lifter 23 is lifted when each sheet stack is sent to the left, while the upper surface of which is monitored by the photoelectric switch so that the upper surface can always be held at a specific height. Also, sheet pile 21 contains sheet makers 19 which were inserted at specific intervals during the preceding process.

In the embodiment described for now, a tilted prone-faced suction disk 52 is provided between the wedge head 51 at its standly position and the end wall of the sheet pile 21, while the lineared motor 56 is also provided for driving the suction disk 52 in the vertical directions. Reference number 57 indicates the other lineared motor driving the pusher unit 54 in the forward and backward directions against the arm 65 of the robot 64. These drivers are secured to the arm A. The edge portion of the suction disk 52 has a tilted angle that nearly faces the tilted angle of the head 51, while said edge portion is connected to a vacuum pump (not shown) to suck up the sheet marker 19. The bottom surface of the wedge head 51 is held in a horizontal plane, and provided with a shallow groove in the forward and backward directions to allow the guide bar 53 to move back and forth along the groove. Reference number 58 indicates a lineared motor driving the guide bar 53, both of which are connected to each other through wires provided inside the guide tube 59. Refeence number 60 indicates a pressor element, which is vertically driven by the pneumatic cylinder 61 secured to the frame 63 being integrated with the base of the robot 64 for pressing the upper surface of the sheet pile 21. Reference number 62 indicates a control unit including such switches for controlling those lineared motors thus described and the suction disk 52 plus the electromagnetic valve as well.

Control of the entire system operation is executed by means of the sequential controller 66 shown in the lower right position of FIG. 6. First, as the table lifter 23 ascends, the upper surface of the sheet pile 21 is brought up to the position shown in FIG. 5, and simultaneously, air is fed into the pneumatic cylinder 61 to lower the position of the pressor element 60 for pressing the sheet pile 21. As soon as the table lifter 23 starts to ascend, the suction disk 52 starts to suck air. While the sheet pile ascends, the suction disk 52 remains at a designated position, and as a result, the uppermost sheet marker 19 projecting from the end wall of the sheet pile 21 comes into contact with the suction disk 52 so that it can be securely sucked by it. When the sheet marker 19 is sucked by the suction disk 52, the pressure inside the vacuum tube lowers, and then the control unit 62 detects the depressurized (vacuum) effect so that the linear head motor 56 can be activated to cause the suction disk 52 to ascend to a specific height. On the other hand, as soon as the uppermost surface of the sheet pile has reached a specific level (see FIG. 5), the photoelectric switch activates itself to stop the ascending operation of the table lifter 23. As the suction disk 52 ascends, the sheet marker 19 being vacuumed by it also ascends, and as a result, as shown in FIG. 6A, the end wall of the sheet pile 21 above the sheet marker 19 is slightly brought upward, thus generating gap "g". Then, the lineared motor 59 rotates to cause the guide bar 53 to proceed. The guide bar 53 remains in parallel with the bottom surface of the wedge head 51. However, since the wedge head 51 slightly inclines upwards itself, the guide bar 53 also keeps proceeding in the slightly face-up posture before being inserted into a position beneath the sheet marker 19 being sucked by the suction disk 52. As a result, the tip end of the guide bar 53 keeps sliding along the bottom surface of the sheet marker 19 until it is smoothly inserted into sheets from the end wall of sheet pile (see FIG. 6B). Such plastic materials featuring satisfactory smoothness, wear resistance, and rigidity are suited for making up the guide bar 53. In particular, polyethylene resin or polytetrafluorethylen resin is most suitable. When the guide bar 53 is inserted into sheets through the end wall, the wedge head 51 then goes forward using the guide bar 53 as a rail, and as shown in FIG. 6C, the wedge head 51 is then inserted into sheet pile 21 through gap provided between the sheet marker 19 and the guide bar 53. Since the wedge head 51 is of wedge shape, insertion of the wedge head 51 causes the sheet pile to be definitely split into two parts, i.e., the uppermost part containing a specific number of sheets and the remainder beneath the inserted wedge head 51. Now, the arm 65 of the robot 64 shown in FIG. 5 receives the drive force in the descending direction to cause the wedge head 51 to press the sheet pile 21 located below the head itself. This prevents sheets below the head 51 from following the specific number of divided sheets in the upper part when they are being sent outside. When the wedge head 51 presses the remaining sheets, the pressor element 60 then ascends to cause the pusher unit 54 to proceed for pushing forward a specific number of split sheets (see FIG. 6D) to the left (see FIGS. 5 and 6D). After the split sheets have been delivered to the left, the pusher unit 54 retreats itself, and then both the wedge head 51 and the guide bar 53 also retreat themselves. Next, the suction disk 52 descends itself, and then the table lifter 23 again starts to ascend itself by a height corresponding to the thickness of the sheet stack 17, and as a result, the apparatus enters the status shown in FIG. 2, thus completing a full cycle operation. Sequential operations are shown in FIG. 6E.

Operating position of the wedge head 51 in the vertical directions is determined by the result of the detection of the sheet marker's position. In the preferred embodiment just described above, the position of the sheet marker is detected by decrease of the pressure inside the suction tube when the suction disk 58 came into contact with the sheet marker 19 and sucked it. In addition to the above preferred embodiments, it is possible, for example, to use photoelectric sensor means set in the same height as that of the wedge head 51 and integrally moves up and down together with the wedge head 51. Alternately, as in the preferred embodiment described earlier, such photoelectric sensor means may be incorporated in the wedge head 51. Although the position of the sheet markers may slightly vary at the left and right ends, depending on the method of inserting the sheet markers during the sheet cutting process, if it is necessary to detect the positions of sheet markers by moving the wedge head 51 to the left and to the right to deal with varied positions of these markers, it is quite convenient to integrally provide the wedge head 51 with such photoelectric sensor means as a unit.

Even if there is any difference in the positions of the sheet markers in the traverse direction along the edge line of sheets after being inserted into sheet stacks at specific intervals during the cutting process, the wedge head shown in FIGS. 7 through 9 can be correctly led to a specific position immediately below the sheet markers using its own photoelectric sensor means incorporated therein.

Figure 7:
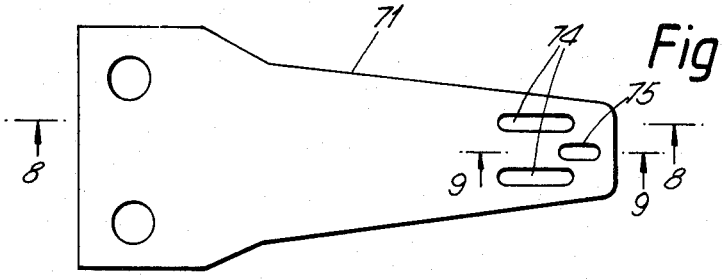
FIG. 7 is a plain view of the wedge-type head provided with another mechanism of sensing sheet markers available for the apparatus embodied by the present invention.
Figure 8:
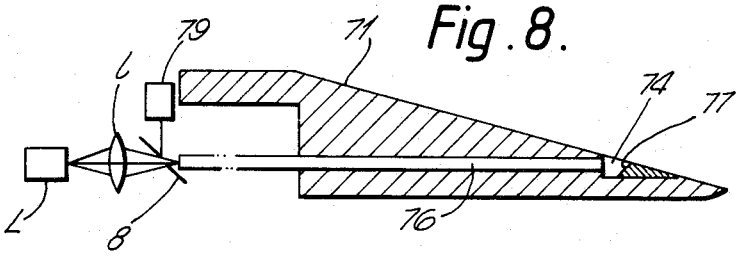
FIG. 8 is a sectional view taken on line 8—8 of FIG. 7.

FIG. 7 shows the upper surface of the wedge head, in which the extreme right end as shown indicates the tip portion of the wedge head, while there are a pair of oval concaves 74, and a comparatively small concave 75 in the tilt surface of the tip portion of the wedge head, thus making up the opening part of photoelectric sensing means. FIG. 8 shows a sectional view taken on line 8—8 of FIG. 7. In reference to the drawing of concave 74, a through-hole is formed through the wedge head 71 extended from the left end as shown, through which an optical fiber 76 is inserted. A stationary light source L is provided at the left tip end of the optical fiber 76 projecting from the wedge head 71, where the light source L is provided across lens "1" and a half mirror 78 so that light can be collected into lens "1" and then led into the optical fiber 76 through the half mirror 78. A mirror 77 being 45° tilted upward in front of the right end of the optical fiber 76 is installed in the concave 74. Light emitted from the right end of the optical fiber 76 reflects from the mirror 77. However, light doesn't reflect itself if nothing is present above. When the wedge head 71 horizontally moves (in the vertical direction in FIG. 7) and the sheet marker 19 is positioned above the concave, after being reflected from mirror 77, light emitted from the optical fiber 76 then reflects from the sheet marker 19 and then again enters into the right end of the optical fiber 76. Thus, light is emitted from the left end of the optical fiber 76 to be reflected upward by the half mirror 78 and then enters into the photo-reception element 79 before eventually being detected by it. The mirror 78 has a transparent portion in its center position to allow beams from the light source L to enter into the left end of the optical fiber 76. As a result, as soon as the photo-reception element 79 has detected light, it instantly identifies that the sheet marker is present above the concave 74. Since there are a pair of such a photoelectric sensor units in both the left and right ends of the upper surface of the wedge head 71, while the sheet markers are simultaneously detected by sensor means on both sides, and thus it is also identified that the wedge head 71 is in the position immediately below the sheet markers. FIG. 9 is a sectional view taken on lint 9—9 of FIG. 7. Reference number 80 indicates the optical fiber which is provided in a hole extended from the central concave to the rear end of the wedge head 71, while the arrangement in the left end of the optical fiber is exactly identical to that of FIG. 8. Since there is no mirror in the right end as shown of the optical fiber 80, the emitted light then radiates the lateral surface of sheet pile 21. While the wedge head 71 remains in a low position and the sheet markers 19 are at the position of solid line shown in FIG. 9, light reflected from the lateral surface of sheet pile 21 enters from the right end of the optical fiber 80. However, since there is a substantial distance from the lateral surface of the sheet pile 21, only a negligiable amount of light can again enter into the right end of the optical fiber 80. However, when the wedge head 71 remains in a correct height, as shown by the dotted line of FIG. 9, the sheet marker 19 covers the concave 75. When this condition exists, most of light emitted from the right end of the optical fiber is reflected by the sheet marker 19 and then again enters into the optical fiber 80, and yet, since the emitted light reflects at such a position very close to the sheet marker 19, the amount of such light again entering into the optical fiber 80 is maximized. As a result, by allowing the light amount detecting output to again enter into the optical fiber 80, the light amount detecting output emitted from the left end of the optical fiber 80 will increase beyond the proper level being set, and thus the height position of the wedge head 71 can be properly regulated during services.

Another means for practically detecting the position of the sheet marker 19 in the embodiment of the present invention is described below. Using such another aspects of means, it is possible to correctly detect the position of the sheet markers 19, for example, by inserting the photo-reception element into the upper surface of the edge head 71 in the upturn direction and by providing a prone-faced light source intergrally movable together with the wedge head 71 in both the vertical and horizontal directions to detect the position of the sheet markers 19 by shutting off light using a sheet marker that has entered between the prone-faced light source and the photo-reception element.

Figure 9:
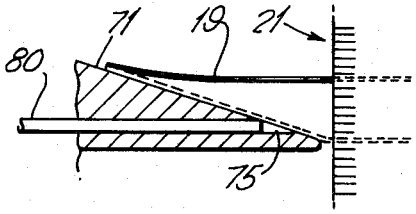
FIG. 9 is a sectional view taken on line 9—9 of FIG. 7.
Figure 6E:
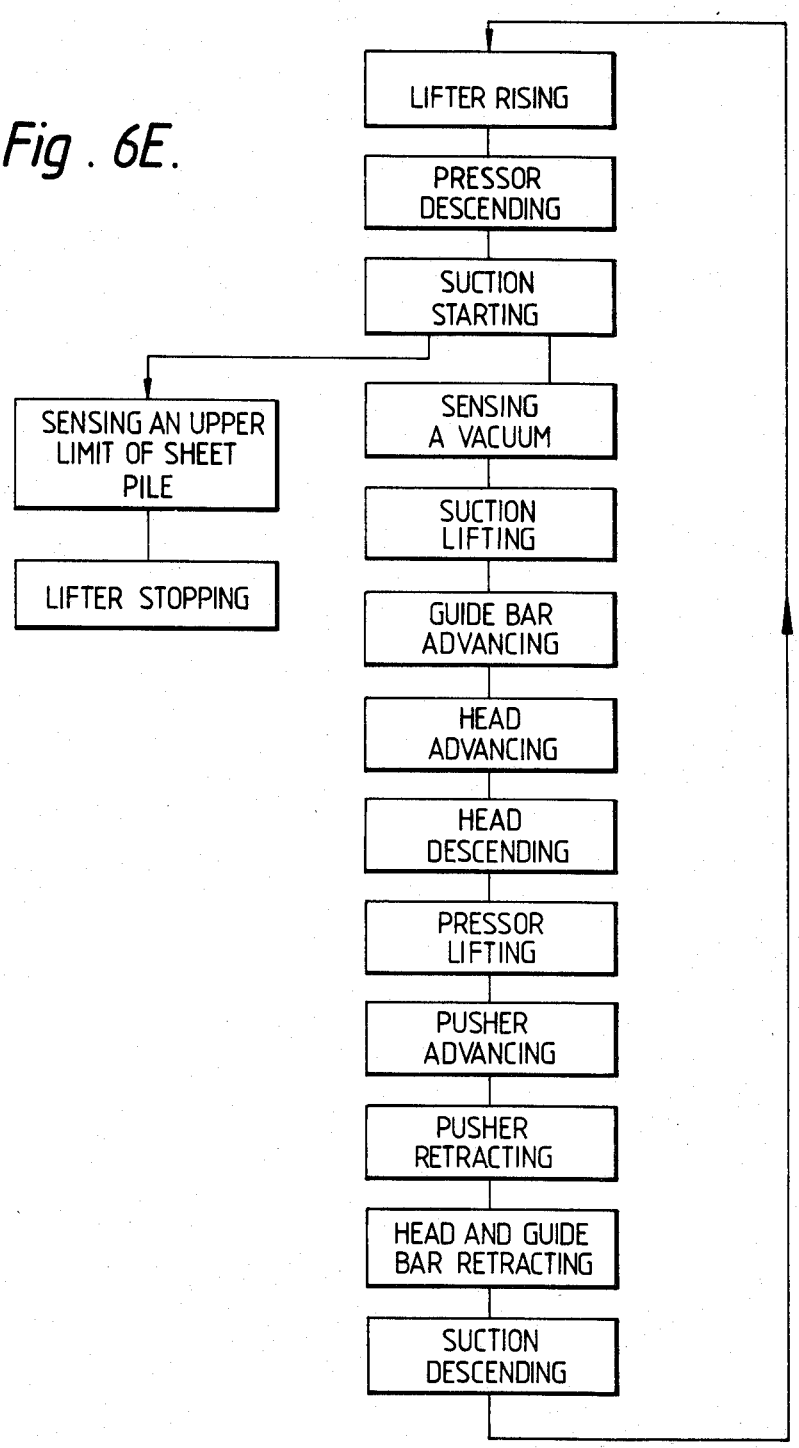
FIG. 6E is a flowchart describing sequential operations performed by the apparatus shown in FIG. 5.

FIG. 10 is the longitudinal sectional view when monitoring the approaching process of the wedge head 71' and the sheet pile 21 by using the wedge head 71' incorporating photo electric sensor means identical to that was shown in FIG. 9. In this case, light emitted from the optical fiber 80' first reflects against the lateral side of the sheet pile 21 and then enters into the tip of the optical fiber 80' and goes out of its rear end at a specific diffusion angle. The outgoing light is then reflected by the half mirror 78', and then enters into the photo-reception element 79' before eventually being detected by sensor means. Since the reflected light from end wall of sheet pile entering into the tip end of the optical fiber 80' irregularly reflects, the farther the distance from the end wall of the sheet pile, the lower will be the luminance against the end wall of the sheet pile, and as a result, the amount of light reflecting from the end wall of the sheet pile 21 entering into the tip end of the optical fiber 80' sharply decreases. Consequently, by measuring the sharply decreased output from the photo-reception element 79', the distance between the tip end of the wedge head 71' and the sheet pile 21 can be correctly identified. When the wedge head 71' scans the position of the sheet marker 19, if the output from the photo-reception element 79' exceeds a specific level, the photoelectric sensor then detects that the tip end of the wedge head 71' approaches too close to the end wall of the sheet pile, and then causes the wedge head 71' to stop its forwarding movement and finally activates alarm means.

FIG. 11 shows the longitudinal sectional view of the pusher unit 102 provided with such means for monitoring the wedge head 71' approaching towards the sheet pile like the one described above.

Reference numeral 103 indicates the optical fiber that penetrates finger "f" of the pusher unit 102, being provided with the identical configuration of the rear end to that of the rear end of the optical fiber 80' shown in FIG. 10. Finger "f" is inserted into gap "g" generated through the end wall of the sheet pile 21 by being led by the wedge head 71'. Light emitted from the tip end of the optical fiber 103 radiates onto the surfaces of both the upper and lower sheets forming gap "g" at a very low incident angle, and as a result, light regularly reflects from the sheet surfaces, while it also repeats reflections deep into gap "g" before gradually and eventually absorbed by sheet surfaces, and as a result, the photo-reception element (not shown) transmits a low-level output while the finger is still in gap "g". Thus, when the photo-reception element transmits a certain output higher than the pre-determined low level, the photoelectric sensor then identifies that gap is insufficiently formed or not being formed at all by the wedge head 71', and then causes the pusher unit to stop its forwarding movement, and finally activates alarm means. This effectively prevents the pusher unit from accidentally hitting against the end wall of the sheet pile even when the end wall projects without correctly being aligned or from forcibly penetrating into the end wall of sheet pile to incur damage onto sheets.

Figure 12:
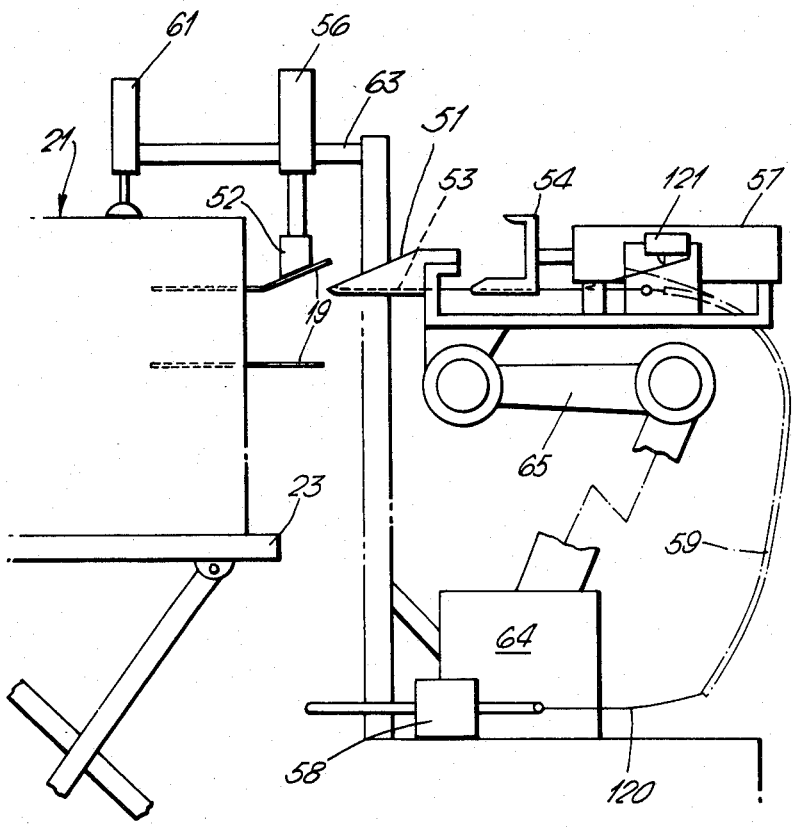
FIG. 12 is a simplified configuration of the apparatus embodied by the present invention, being provided with the guide bar safety device.

FIG. 12 shows another preferred embodiment of the present invention designed for generating alarm upon detection of such a symptom in which the guide bar beneath the wedge head cannot be smoothly inserted into gap generated through the end wall of sheet pile. The apparatus shown in FIG. 12 uses such component parts substantially identical to those which were shown in FIGS. 5 and 6, where such parts indicated by the identical reference numbers match those parts appearing in the following description. In the preferred embodiment shown in FIG. 12, the microswitch 121 for sensing the overloaded guide bar and the related control circuit (not shown) comprise additional proper parts different from other embodiments. The microswitch 121 comprises an actuator lever provided above wire 120. If there is any resistance when inserting the guidebar 53 into gap through the end wall of sheet pile 21, wire 120 is pressed by the lineared motor 58, and as a result, the wire 120 bends itself to form an upward convex as shown by broken line, causing the actuator of the microswitch 121 to be pressed ON and allowing sensor means to detect that the guide bar cannot properly be inserted into the sheet pile 21, and finally, as soon as the lineared motor 58 is turned OFF, alarm means is activated.

This preferred embodiment is designed to inhibit the guidebar to be unreasonably inserted into sheets, thus effectively preventing even the slightest damage from incurring onto the sheet surface, and at the same time, ensuring the guide bar correctly and smoothyl inserted into the designated position.

FIG. 13 shows another preferred embodiment in which the pusher unit 14 to 54 (see FIGS. 1, 5 and 12) is driven in the slightly tilted upward direction. Specifically, this embodiment provides such a control unit causing the pusher unit 14 or 54 to go forward after forming gap in the border end wall of sheet stacks using the wedge head before pushing forward the uppermost sheet stack. When employing this embodiment, after inserting the wedge head between sheets, by setting the forwarding direction of the pusher unit 14 and 54 at such an angle slightly tilted upward from the horizontal level, the bottom surface of the pusher unit 14 to 54 remains apart from the upper surface of the second sheet stack to prevent damage to be caused by abrasion. About 2° of the tilted angle is ideally suited for this arrangement. In this embodiment, since the pusher unit goes forward at a tilted angle slightly up from the horizontal level, even if a certain bending moment may affect the tip part of the pusher unit from the sheet stack, the bottom surface of the pusher unit doesn't rub the upper surface of the second sheet stack at all, and thus, this embodiment is advantageous when dealing with delicate sheets including art paper, coated paper, high-glazed finish paper, etc.

The preferred embodiments of the present invention thus far described in detail provide such manners and means for correctly identifying the needed number of sheets in a stack in reference to the sheet markers previously inserted at specific intervals into the end wall of sheet pile; such manners and means for securely splitting the transferrable sheet stack from the remainder by lifting the identified sheet markers and generating adequate gap between the uppermost and second sheet stacks without causing even the slightest damage onto the sheet surfaces of both sheet surfaces and yet without incorrectly splitting these; and such manners and means for securely receiving the edge portion of the separated sheet stack using the tip part of sheet forwarding means before safely pushing forward the separated sheet stack to the ensuing process without incurring even the slightest damage onto the upper surface of the second stack.

These preferred embodiments may be easily and variably modified into similar apparatuses by those skilled in the art within the scope of the invention. It should be understood however that the scope of the present inventon is defined only within the following claims attached hereto.

What is claimed is:

1. A method for sequentially feeding sheet stacks bordered by sheet markers from a pile of aligned and stacked sheets containing sheet markers inserted into these sheets through end wall at specific intervals with a bare portion left outside, using a sheet stack delivery apparatus including at least lifter means that mounts sheet stacks to allow the uppermost sheet stack to be sequentially transferred to a pre-determined level; a wedge-type head for separating sheet stacks comprising its tip part facing the end wall of the sheet pile at a position close to the sheet marker bordering the uppermost and the second sheet stacks and also the upper tilt surface and the bottom surface ending at the tip part; and means for transferring the uppermost sheet stack by holding and pushing forward an end wall of the uppermost sheet stack split by the wedge head; said method comprising the steps of:

(a) lifting a pile of sheets by driving the lifter in order that the uppermost sheet stack can be lifted to such a level allowing its transfer;

(b) sucking and holding the bare portion of the sheet markers between the uppermost sheet stack set at the transferrable level and the second sheet stack to cause a gap to be generated between the sheet marker and the second sheet stack by raising the height position of suction means;

(c) inserting guide means composed of relatively rigid and smooth sheet into said gap generated by step (b);

(d) inserting the wedge head into said gap above said guide means inserted into said gap in such a manner that the bottom surface of the wedge head comes into contact with the upper surface of guide means so that said gap can be expanded to allow lifting of the uppermost sheet stack at its end wall; and (d) receiving and holding the end wall of the lifted sheet stack at the receiver part of the tip of feeding means and transferring the lifted sheet stack by forwarding said feeding means.

2. Apparatus for sequentially feeding sheet stacks bordered by sheet markers from a pile of aligned and stacked sheets containing sheet markers inserted into these sheets through end wall at specific intervals with bare portion left outside comprising:

(a) lifter means for mounting and lifting sheet stacks to sequentially place the uppermost sheet stack onto the transferrable level;

(b) a wedge type head incorporating marker sensing means and sucking means for separating sheet stacks, having the tip portion facing an end wall of the sheet stacks at a position close to the sheet marker bordering the transferrable sheet stack and the second sheet stack, the tilted upper surface and the flat bottom surface;

(c) robot means for functioning to hold and control the position and posture of the wedge head together with and in conjunction with said suction means, thereby causing the wedge head to rise for sensing the position of the sheet markers with sensing means and then slightly lift the bare portion of the sheet markers to suck and hold the bare portion at the lifted position to allow at least a portion of the wedge head to also rise for generating gap between the bottom surface of the sheet markers and the second sheet stack to be followed by releasing the sucking operation of the sheet markers before allowing entry of the wedge head into said gap;

(d) a rigid and smooth guide bar means being held in conjunction with the wedge head and slidably along the bottom surface of the wedge head for acting as the guide rail of the wedge head into said gap upon it having been inserted thereto;

(e) transferring means for holding and pushing forward an end wall of the uppermost sheet stack in order to transfer said sheet stack to ensuing processes.

3. The apparatus according to claim 2, wherein said at least a portion of the wedge head to be lifted is the rear end portion thereof, and the rear end portion is pivotally lifted about the tip end thereof.

4. The apparatus according to claim 2, further including means for pressing the upper edge portion of the sheet stack at the transferrable level of the sheet pile, and maintaining the pressing state until the gap between the uppermost and the next stacks having been produced.

* * * * *

UNITED STATES PATENT AND TRADEMARK OFFICE

CERTIFICATE OF CORRECTION

PATENT NO. : 4,623,292

DATED : November 18, 1986

INVENTOR(S) : Suzuki et al

It is certified that error appears in the above-identified patent and that said Letters Patent is hereby corrected as shown below:

Column 3, line 32, after "forwarding" insert --means--

Column 4, line 17, "mebodied" should read --embodied"

Column 4, line 64, "norrower" should read --narrower--

Column 5, line 43, "ressin" should read --resin--

Column 6, line 63, "as" should read --a--

Column 7, line 42, "makers" should read --markers--

Column 8, line 31, "59" should read --58--

Column 10, line 10, "lint" should read --line--

Signed and Sealed this

Third Day of March, 1987

*Attest:*

DONALD J. QUIGG

*Attesting Officer*

*Commissioner of Patents and Trademarks*